United States Patent [19]

Cox

[11] Patent Number: 4,476,925

[45] Date of Patent: Oct. 16, 1984

[54] SAND SHIELD FOR BOTTOM HOLE PUMPS

[76] Inventor: Pope D. Cox, P.O. Box 1182, Drumright, Okla. 74030

[21] Appl. No.: 488,207

[22] Filed: Apr. 25, 1983

Related U.S. Application Data

[63] Continuation-in-part of Ser. No. 422,706, Sep. 24, 1982, abandoned.

[51] Int. Cl.[3] ..... E21B 43/00

[52] U.S. Cl. ..... 166/105.1; 166/236; 210/436; 210/456; 210/472

[58] Field of Search ..... 166/236, 227, 229, 234, 166/235, 105.1–105.5; 210/456, 170, 460, 461, 436, 472

[56] References Cited

U.S. PATENT DOCUMENTS

| | | | |
|---|---|---|---|
| 609,269 | 8/1898 | Etheridge | 166/236 |
| 794,943 | 7/1905 | Kleckner | 166/236 |
| 1,329,171 | 1/1920 | Garry | 166/105.1 |
| 1,379,302 | 5/1921 | Hart | 166/105.1 |
| 1,488,106 | 3/1924 | Fitzpatrick | 166/105.1 |
| 1,548,803 | 8/1925 | Cotton | 166/105.1 |
| 2,346,602 | 4/1944 | O'Bannon | 166/105.1 |
| 2,665,645 | 1/1954 | Wells | 166/105.1 |
| 2,681,111 | 6/1954 | Thompson | 166/236 |

*Primary Examiner*—James A. Leppink
*Assistant Examiner*—Hoang C. Dang
*Attorney, Agent, or Firm*—Head, Johnson & Stevenson

[57] ABSTRACT

An improved sand shield is provided for use on the end of a string of tubing suspended in a casing in a borehole in an oil well to reduce the entrance of sand into a bottom hole pump, the sand shield being in the form of a length of tubular material surrounding a perforated mud anchor in which the bottom hole pump is situated, the produced fluid being forced to flow upwardly in the annular area between the mud anchor and sand shield to enter the pump, and including vents communicating with the upper portion of the annular area to provide for the escape of gas trapped within the sand shield.

1 Claim, 2 Drawing Figures

SAND SHIELD FOR BOTTOM HOLE PUMPS

CROSS-REFERENCE

This is a continuation-in-part of application Ser. No. 422,706 filed Sept. 24, 1982, entitled "Sand Shield For Bottom Hole Pumps", now abandoned.

BRIEF SUMMARY OF THE INVENTION

The usual means of producing an oil well which does not have sufficient formation pressure to cause the oil to flow to the earth's surface is by means of bottom hole pumps. The most commonly accepted method of actuating a bottom hole pump is by means of a string of sucker rods extending from the earth's surface. In a typical pumped oil well, a casing is positioned in the borehole after it is drilled. The casing has perforations in it which permits fluid to flow from the producing formations into the interior of the casing. A string of tubing is suspended in the casing from the earth's surface through which the produced fluid is pumped to the surface. At the end of the string of tubing a seating nipple is employed as a means of anchoring and sealing a bottom hole pump. Sucker rods extend from the bottom hole pump to the surface, and by actuation of the reciprocal actuation of the sucker rods the pump moves fluid within the tubing up to the earth's surface.

Some formations include a large quantity of loose sand. As the crude oil flows from the formation into the borehole, this loose sand is carried with it; and if fluid is permitted to pass from within the interior of the casing into the pump, the pump can quickly become inoperative because of the accumulation of sand. This is referred to in the industry as the pump being "sanded up". The accumulation of sand within the pump interferes with the valve operations and with the reciprocal action of the pump. Not only does an excessive amount of sand increase wear, thereby shortening the useful life of a bottom hole pump, but it can accumulate to such an extent that the pump become inoperative.

In some formations the quantity of sand carried by the produced fluid is so great that a pump becomes inoperative soon after it is installed. In these wells it is necessary to pull the pump out of the well as frequently as every 15 to 25 days. This, of course, is expensive. In addition, when the pump becomes inoperative, production is lost until the pump has been pulled and replaced.

The present invention provides a means of reducing the amount of sand which is carried by production fluid from a borehole into a pump. Particularly, the invention provides a sand shield to intercept the direct flow path of production fluid, affording opportunity for sand carried by the fluid to be dropped out before the fluid enters the pump. The invention provides an annular area through which the produced fluid must flow upwardly in order to enter the pump. Fluid flowing from the borehole normally changes directions as it moves upwardly into the annular area, providing opportunity for sand to be discharged from the flow stream. The upward movement of the fluid affords opportunity for sand to drop from the fluid.

The invention also provides means for venting gas from the annular area thus preventing the possibility of gas lock of the sand shield.

To achieve these results, a seating nipple is secured to the lower end of a string of tubing positioned within a casing in a borehole. The seating nipple provides means to support and seal a sucker rod actuated bottom hole pump of the standard and typical type commonly employed in the petroleum industry. Attached to the lower end of the seating nipple is an elongated tubular mud anchor having perforated sidewalls. The mud anchor is usually closed at the bottom.

Also secured to the lower end of the seating nipple is a tubular sand shield. The sand shield coaxially receives the mud anchor and has an internal diameter which is larger than the external diameter of the mud anchor. This provides an annular area between the exterior of the mud anchor and the interior of the sand shield. The sand shield has a length which extends below the lowest perforation in the mud anchor so that fluid will flow upwardly in the annular area before entering into the mud anchor.

Thus the sand shield intercepts the direct flow of sand laden fluid from the producing formation and channels the flow in such a way as to significantly reduce the amount of sand carried by the produced fluid into the bottom hole pump. At the upper end of the sand shield a means is provided for gas to escape from the annular area between the mud anchor and the sand shield to prevent the possibility of gas lock.

DETAILED DESCRIPTION

Figure 1:
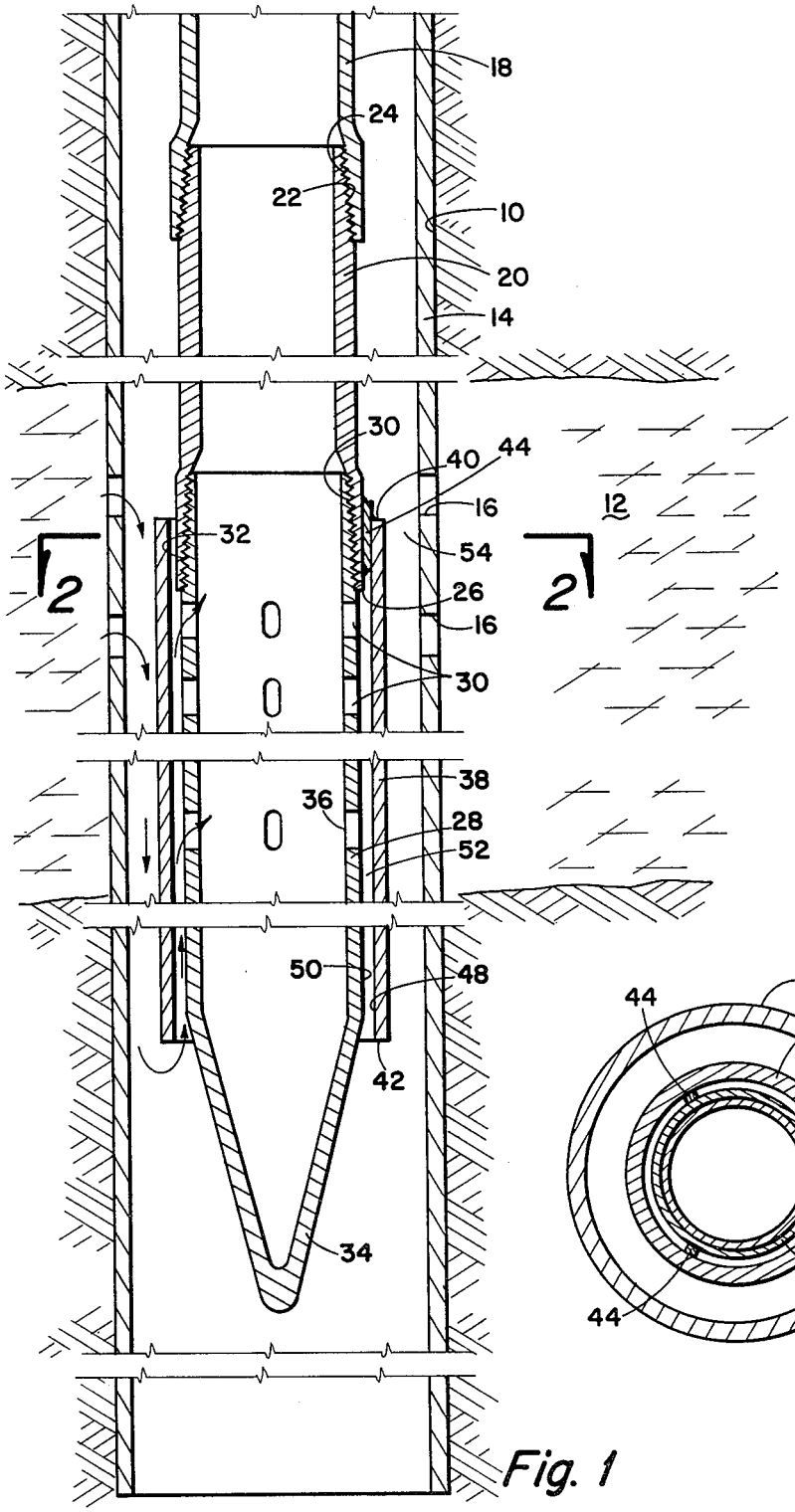
FIG. 1 is an elevational, cross-sectional view of the lower end of a borehole forming an oil well. The drawing shows casing extending from the earth's surface in the borehole and tubing which also extends from the earth's surface within the borehole. Attached to the tubing is a seating nipple and to it a mud anchor and the sand shield of this invention. The figure shows the elevational view broken in several places since the elements illustrated are all of relatively small diameter and of long length.

The drawing shows the lower portion of a borehole 10. The borehole passes through a producing formation 12. Positioned within the borehole 10 and extended to the earth's surface is a casing 14 which typically may be 5 to 8 inches in diameter. To permit fluid to flow from the producing formation 12 into the interior of casing 14, perforations 16 are typically provided in the casing.

As has previously been stated, in some wells the producing formation 12 has a large amount of disassociated sand particles which are carried by the produced fluid as it flows from the formation. These sand particles if carried directly into a bottom hole pump, can cause the pump to not only wear rapidly but, in addition, can cause it to become inoperative in a relatively short length of time.

Extending to the earth's surface is a string of tubing 18, only the lower end of which is shown. It is through the tubing 18, which is typically 2 to 3 inches in diameter, that the produced fluid is pumped to the earth's surface for subsequent conveyance to a pipeline.

Affixed to the lower end of tubing 18 is a seating nipple 20. The seating nipple is provided with an internally threaded upper end 22 which is secured to the lower end of the tubing 18. In the drawing the tubing 18 is shown with an upset end with internal threads 24. In many applications the seating nipple 20 will be connected to tubing 18 by means of a coupling.

Affixed to the lower end 26 of the seating nipple is a mud anchor 28 which is of elongated tubular configuration and functions as a protector for a sucker rod actuated bottom hole pump (not shown) supported in the seating nipple 20. The mud anchor has external threads 32 which engage internal threads 30 of the seating nipple.

The seating nipple is typically closed at its lower end and in the illustrated embodiment has an integrally formedclosed pointed lower end 34. Perforation openings 36 are formed in the sidewall of the mud anchor by which fluid can flow into it and thus into a pump for transportation within the tubing 18 to the earth's surface.

If the type of sucker rod actuated bottom hole pump to be received and supported within the seating nipple 20 is of the top hold-down type, most of the pump is therefore received within the mud anchor 28, and it will be of a length sufficiently long to receive the pump. However, if the type of pump is of the bottom hold-down type, the portion of the pump extending within the mud anchor is relatively short. Therefore, the length of mud anchor 28 may vary from a few feet to as much as 18 feet in length and will normally be of a diameter substantially equal to that of tubing 18, that is, from about 2 to 3 inches.

Figure 2:
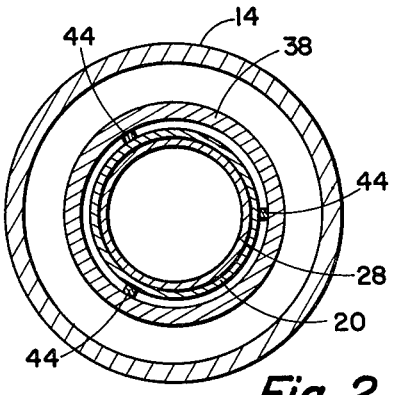
FIG. 2 is a cross-sectional view taken along the line 2—2 of FIG. 1 showing one means of mounting the sand shield to provide means for the flow of gas from within the upper portion of the said shield to thereby prevent gas lock.

Affixed to the lower end of the seating nipple 20 is a tubular sand shield 38 having an upper end 40 and a lower end 42. Secured, such as by welding, to the exterior of the lower end of the seating nipple are a plurality (3 being shown in FIG. 2) of spacers 44. These spacers are received by the upper end of sand shield 38. The sand shield is secured to spacers 44 such as by welding at the sand shield upper end 40.

The internal diameter 48 of the sand shield is larger than the external diameter 50 of the mud anchor providing an annular space 52. The length of the sand shield 38 is sufficient so that the lower end 42 is below the lowermost perforation 36 in the mud anchor. In the preferred arrangement the lower end 42 of the sand shield is at least about 2 feet below the lowest mud anchor perforation 36.

When fluid from producing formation 12 flows through the perforations 16 in casing 14, it enters the annular area 54 between the exterior of the sand shield and the interior of the casing. The flow passes downwardly in the directions indicated by arrows on the left side of the drawings, past the lower end 42 of the sand shield, and upwardly within the annular space 52 between the exterior of the mud anchor and the interior of the sand shield. Sand carried by the produced fluid flowing through perforations 16 is thus prevented from directly entering into the interior of the mud anchor and thereby prevented from entering into the downhole pump positioned within the mud anchor. As the fluid travels downwardly within the annular space 54 and then reverses direction to travel upwardly within the annular space 52, the change of fluid flow directions will cause sand particles to drop out. In addition, as the fluid migrates upwardly within the annular space 52, further opportunity is given for the sand to drop out. The sand thus is separated by the flow action created by the sand shield 38 to protect the interior of the mud anchor from the accumulation of sand and to cause the sand to fall downwardly and accumulate in the lower end of the interior of the casing 14.

Gas carried by or forming a part of the flow entering the open bottom 42 of the sand shield tends to collect in the upper interior portion of the sand shield and, in some instances, can cause the pump to become gas locked. By the provision of spacers 44, the annular area 52 is open at the top, permitting gas within the sand shield to escape, thus preventing the possibility of a gas lock.

The flow of gas outwardly through the open spaces provided by spacers 44 effectively prevents sand from entering downwardly into the annular area 52.

It can be seen that other means may be provided for mounting sand shield 38 to the seating nipple 20, such as by a threaded connection, and in such case, gas escape openings (not shown) may be formed in the wall of the sand shield adjacent the top portion.

This invention provides means of effectively shielding a bottom hole pump from the direct entry of sand carried by the fluid to be pumped while at the same time preventing gas lock of the sand shield apparatus.

Experimentation has shown that in wells which produced high rates of sand the useful pump life can be substantially extended by use of the sand shield. This means that the wells have to be pulled less frequently, resulting in saving the cost of pulling operations and increasing production by decreasing the well shutdown time.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. For use on the lower end of a string of tubing suspended in a casing in a borehole in an oil well, an improved apparatus for reducing the entrance of sand into a bottom hole pump, comprising:

a seating nipple secured at its upper end to the lower end of a string of tubing, the seating nipple having an interior configuration to receive and support a sucker rod actuated bottom hole pump therein, the seating nipple having internal threads at the lower end thereof;

a mud anchor having external threads on the upper end thereof threadably engaging said seating nipple lower internal threads whereby the mud anchor is secured to the lower end of said seating nipple and extends coaxially downwardly therefrom, the mud anchor being tubular and of internal diameter greater than the external diameter of a bottom hole pump to be received and supported in said seating nipple, the mud anchor having perforations therein through which fluid flows;

spacers affixed in spaced apart relationship to the external surface of the lower end of said seating nipple;

a tubular sand shield secured at its inner periphery of its upper end to said spacers affixed to the lower end of said seating nipple whereby the sand shield extends coaxially downwardly from said seating nipple, the sand shield coaxially receiving said mud anchor therein and having an internal diameter greater than the external diameter of said mud anchor providing a vertical annular area therebetween, the vertical annular area having an upper portion, the lower end of the sand shield being below the lowest perforations in said mud anchor whereby fluid from the well borehole must flow upwardly in said annular area to enter into said mud anchor and thence into a pump operated within the mud anchor, the upper end of said annular area being open between said spacers providing communication between the upper portion of said annular area with the interior of said casing for the passage of gas directly upwardly therethrough.

* * * * *